US007806661B2

(12) United States Patent
Duffield

(10) Patent No.: US 7,806,661 B2
(45) Date of Patent: Oct. 5, 2010

(54) PROPELLER

(75) Inventor: Marshall Duffield, Newport Beach, CA (US)

(73) Assignee: Duffield Marine, Inc., Costa Mesa, CA (US)

( * ) Notice: Subject to any disclaimer, the term of this patent is extended or adjusted under 35 U.S.C. 154(b) by 204 days.

(21) Appl. No.: 12/142,046

(22) Filed: Jun. 19, 2008

(65) Prior Publication Data

US 2008/0267782 A1 Oct. 30, 2008

Related U.S. Application Data

(63) Continuation of application No. 11/145,828, filed on Jun. 6, 2005, now abandoned.

(51) Int. Cl.
*F04D 3/02* (2006.01)

(52) U.S. Cl. ..... 416/176; 416/223 R; 416/DIG. 2

(58) Field of Classification Search ..... 416/DIG. 2, 416/244 B, 176, 239, 227 A, 213 A
See application file for complete search history.

(56) References Cited

U.S. PATENT DOCUMENTS

D33,386 S 10/1900 Rondell
885,174 A * 4/1908 Perkins ..... 416/234
1,363,660 A * 12/1920 La Fleur ..... 416/200 R
1,850,476 A 3/1932 Hans
2,011,821 A 8/1935 Meyer et al.
3,081,826 A 3/1963 Loiseau
4,482,298 A 11/1984 Hannon et al.
4,775,297 A 10/1988 Bernauer
5,104,292 A 4/1992 Koepsel et al.
5,236,310 A 8/1993 Koepsel et al.
5,249,993 A * 10/1993 Martin ..... 440/73
5,352,093 A * 10/1994 Hannon et al. ..... 416/234
6,702,552 B1 * 3/2004 Harman ..... 416/223 R
7,025,642 B1 * 4/2006 Baylor ..... 440/49
D562,215 S 2/2008 Schulze

OTHER PUBLICATIONS

Lear Baylor, Inc. "Lear Letric Propulsion System"; Website Article http://www.learbaylor.com; pp. 1-2.

* cited by examiner

*Primary Examiner*—Richard Edgar
(74) *Attorney, Agent, or Firm*—Stetina Brunda Garred & Brucker

(57) ABSTRACT

A propeller attached to an output shaft of a boat motor is provided. The propeller may have a plurality of blades which define a leading edge. The leading edge may define leading edge angles which increase in a logarithmic manner from a base of the blade to a tip of the blade. This allows the blades of the propeller to cut and shed seaweed and/or kelp off of the blades when the boat is maneuvered into waters containing seaweed and/or kelp. Additionally, boats that employ the propeller of the present invention are quieter compared to boats that utilize prior art propellers.

19 Claims, 3 Drawing Sheets

PROPELLER

CROSS-REFERENCE TO RELATED APPLICATIONS

The present application is a continuation of U.S. patent application Ser. No. 11/145,828 entitled IMPROVED PROPELLER filed Jun. 6, 2005 now abandoned, the entirety of the disclosure of which is expressly incorporated herein by reference.

STATEMENT RE: FEDERALLY SPONSORED RESEARCH/DEVELOPMENT

Not Applicable

BACKGROUND OF THE INVENTION

The present invention relates to a propeller of a boat.

Every boat based on its design and intended use will require a different type of propulsion system. One of the most common types of propulsion system is the propeller propulsion system which is essentially a propeller submerged under water and attached to the boat such that rotation of the propeller in the water thrusts the boat forward. An inboard or outboard motor rotates the propeller which displaces water in an astern direction. In particular, the displaced water develops a reactionary force which thrusts the boat forward.

The amount of thrust created by the blades of the propeller is dependent upon many factors. For example, one factor that determines the amount of thrust created by the propeller is the angle of attack of its blades. Generally, the greater the angle of attack of the blades; the greater the amount of thrust created by the propeller. Other factors external to the blade design also affect the amount of thrust created by the propeller. For example, seaweed and kelp may get tangled within the blades of the propeller themselves when the boat travels in waters (e.g., seas, rivers, and lakes). The tangled seaweed and kelp add weight to the propeller such that the motor must exert more energy to maintain the propeller's rotational speed compared to the amount of power required to rotate the propeller if the propeller had not been entangled with seaweed and kelp. Also, the tangled seaweed and/or kelp may be so entangled with the propeller that the propeller stops rotating. The problems discussed above with seaweed and kelp being entangled with the propeller is further accentuated if the propeller rotates at a low speed (i.e., boats traveling less than about seven miles per hour) because the propeller is not able to break free from the entangled seaweed and kelp.

Accordingly, there is a need in the art for an improved propeller to address deficiencies in the prior art discussed above.

BRIEF SUMMARY OF THE INVENTION

A propeller is provided which has a unique design such that it is capable of shedding and cutting seaweed and kelp as the boat travels through water having seaweed and kelp. The unique design of the propeller's blades also allow the propeller to shed and cut seaweed and kelp at low speeds (i.e., low revolutions per minute or boats traveling at less than about 7 miles per hour). Further, the propeller may be fabricated from a urethane material such that the blades of the propeller break/snap off when the blades hit an object thereby preventing stress on the shaft and electronics. Additionally, the boats are quieter and run smoother when the propellers of the present invention are used to propel the boats.

The propeller of the present invention may have at least two blades, and more preferably, five blades. Each of the propeller's blades may have a leading edge and a trailing edge. The leading edge may have a logarithmic spiral configuration. More particularly, the leading edge may define a leading edge angle which is defined by a tangent line to the leading edge and a line defined by the center of the propeller and the contact point of such tangent line to the leading edge. The leading edge angle may increase at approximately a logarithmic rate along the leading edge starting from the blade base at about at least 27 degrees to the blade tip at about 90 degrees. This logarithmic spiral shaped leading edge cuts and/or sheds seaweed and kelp off of the leading edge such that such seaweed and kelp does not affect the blades propulsion characteristics. Moreover, the logarithmic spiral shaped leading edge provides skew to the planform for blade stability and noise reduction.

The radial cross sections of each blade may also have the same general shape. For example, the thickness ratio of the cross sections of each blade may be about 12%. Additionally, the camber percentage of the cross sections of each blade may be about 3%.

For low speed boats, the propeller is preferably fabricated from urethane plastic such that the blades break/snap off when the blades hit an object to prevent stress on the propeller shaft and electronics. A propeller having blades with the above configuration fabricated from urethane provides sufficient stiffness for performance yet allows the blades to break/snap off when the blades hit an object.

BRIEF DESCRIPTION OF THE DRAWINGS

These as well as other features of the present invention will become more apparent upon reference to the drawings wherein.

DETAILED DESCRIPTION OF THE INVENTION

Figure 1:
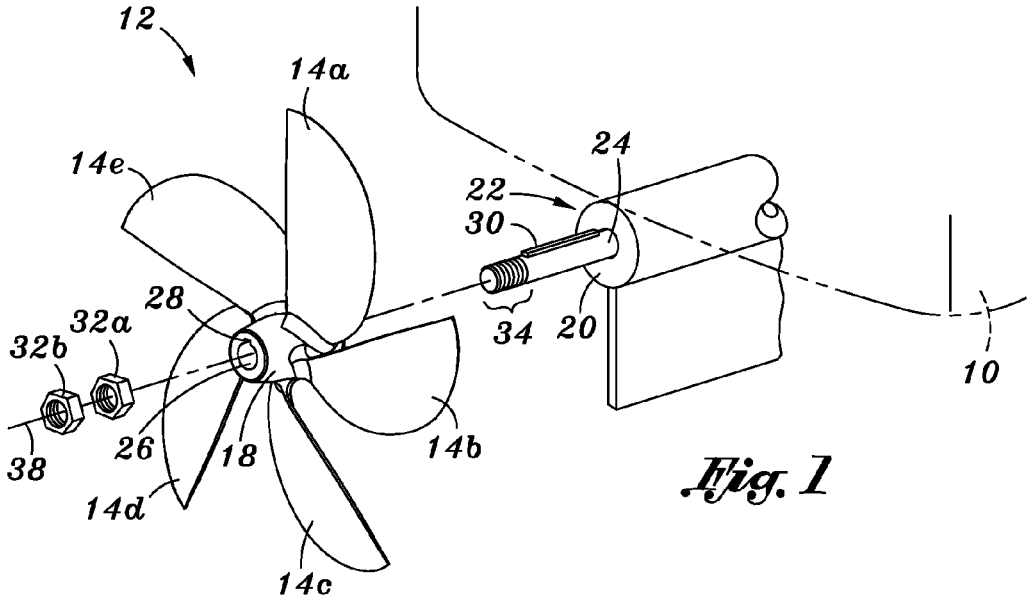
FIG. 1 is a front perspective view of a propeller attached to an output shaft of a boat motor.

The drawings referred to herein are for the purposes of illustrating the various aspects of the present invention and not for the purpose of limiting the same. Referring now to FIG. 1, a silhouette of a boat 10 is illustrated having a propeller 12 to propel the boat 10 through the water. The propeller 12 due to its unique construction and shape is able to cut and/or shed seaweed and kelp from its blades 14*a-e*. As such, the propeller 12 of the present invention provides an improved propeller 12 over the prior art propeller because the improved propeller 12 is able to thrust boats 10 through waters containing seaweed and kelp without the propeller blades 14*a-e* becoming entangled with the seaweed and kelp. Also, due to the unique construction of the propeller 12, the propeller blades 14*a-e* are able to cut and/or shed seaweed and kelp when the propeller 12 is rotating at slow speeds (i.e., low revolutions per minute). As such, the propeller 12 of the present invention provides an improved propeller 12 that is able to thrust boats 10 slowly through waters containing seaweed and kelp without becoming entangled with the seaweed and kelp.

A front face of the propeller 12 is shown in FIG. 1. The propeller 12 has five blades 14*a-e* which are attached to a centrally formed hub 18. The five blades 14*a-e* extend radially outward from the hub 18 and are equidistantly spaced apart from each other. For example, the five blades 14*a-e* may be spaced 72 degrees apart from each other. However, it is also contemplated within the scope of the present invention that the propeller 12 may have two, three, four, or six or more blades 14. Additionally, it is also contemplated within the scope of the present invention that the blades 14 be attached to the hub 18 in a manner not angularly equidistant from each other. Rather, the blades 14 may be angularly spaced apart from each other in an uneven manner as long as the propeller 12 applies a uniform thrust force onto a shoulder 20 of an interface 22 of the boat motor and the propeller 12. For example, a first set of two blades 14 may be spaced 72 degrees apart from each other and a second set of two blades 14 may be spaced 180 degrees apart from the first set.

The propeller 12 may be mounted onto an output shaft 24 of the interface 22. More particular, the hub 18 of the propeller 12 may have a through-hole 26 formed therethrough. The through-hole 26 may be sized and configured to receive the output shaft 24. For example, the through-hole 26 which has a round configuration may match the output shaft 24 which may be a round bar. The output shaft 24 is inserted through the through-hole 26 of the hub 18 to mount the propeller 12 onto the output shaft 24. Additionally, the through-hole 26 is also formed with an internal groove 28 (see FIGS. 1 and 2) which may extend between a front face (see FIG. 1) and back face (see FIG. 2) of the propeller 12. The internal groove 28 may be a key way and may be sized and configured to match a key 30 (see FIG. 1) which protrudes from an external surface of the output shaft 24. When the propeller 12 is mounted onto the output shaft 24, the key 30 is also inserted into the internal groove 28. In this manner, the rotation of the output shaft 24 also rotates the propeller 12. It is also contemplated within the scope of the present invention that output shaft 24 may have other configurations to rotate the propeller 12 that may be employed with the various aspects of the present invention discussed herein.

The propeller 12 is locked onto the output shaft 24 through two nuts 32*a, b* that thread onto a threaded portion 34 of the output shaft 24. Once the output shaft 24 is inserted through the hub through-hole 26, the threaded portion 34 of the output shaft 24 is exposed. A first nut 32*a* is threaded onto the threaded portion 34 to tighten the propeller 12 onto the output shaft 24. A second nut 32*b* is then threaded onto the shaft's threaded portion 34 to lock the first nut 32*a* on the shaft's threaded portion 34. Accordingly, during operation of the propeller 12, the propeller 12 is locked onto the output shaft 24.

Figure 3:
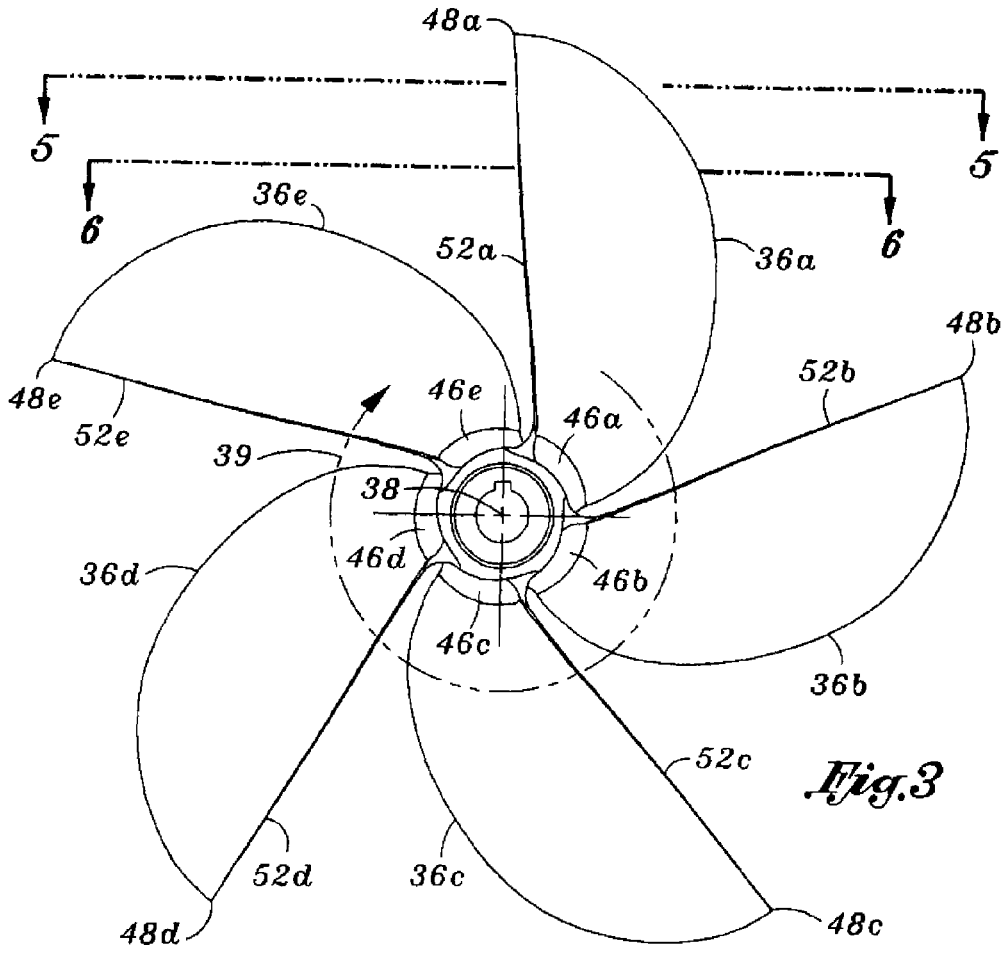
FIG. 3 is a front plane view of the propeller of FIG. 1.

Referring now to FIG. 3, the blades 14*a*, 14*b*, 14*c*, 14*d*, 14*e* of the propeller 12 each have a leading edge 36*a-e* which has a spiral shape. The spiral shape cuts and/or sheds seaweed and kelp off of the leading edges 36*a-e* such that the seaweed and/or kelp do not get caught in the propeller 12. In other words, the seaweed and kelp slides off of the leading edges 36*a-e*, or in the alternative, the leading edges 36*a-e* of each blades 14*a-e* may cut the seaweed and kelp off of the blades 14*a-e* such that the propeller 12 does not get tangled with the seaweed and kelp. For example, the blades 14*a-e* shown in FIG. 3 rotates in the clockwise direction about a central propeller axis 38 (see FIGS. 1 and 3) in direction 39 (see FIG. 3). It is also contemplated within the scope of the present invention that the various aspects of the present invention may be employed in blades 14 that rotate counter-clockwise to thrust the boat 10 through the water. As the blades 14*a-e* rotate through the water, the leading edges 36*a-e* may encounter seaweed and kelp. Due to the spiral configuration of the leading edges 36*a-e*, the encountered seaweed and kelp may slide off of the blades 14*a-e*. Alternatively, for seaweed and kelp which do not slide off of the blades 14*a-e*, the leading edges 36*a-e* may cut through the seaweed and kelp to prevent the propeller 12 from getting tangled with the seaweed and kelp.

Figure 4:
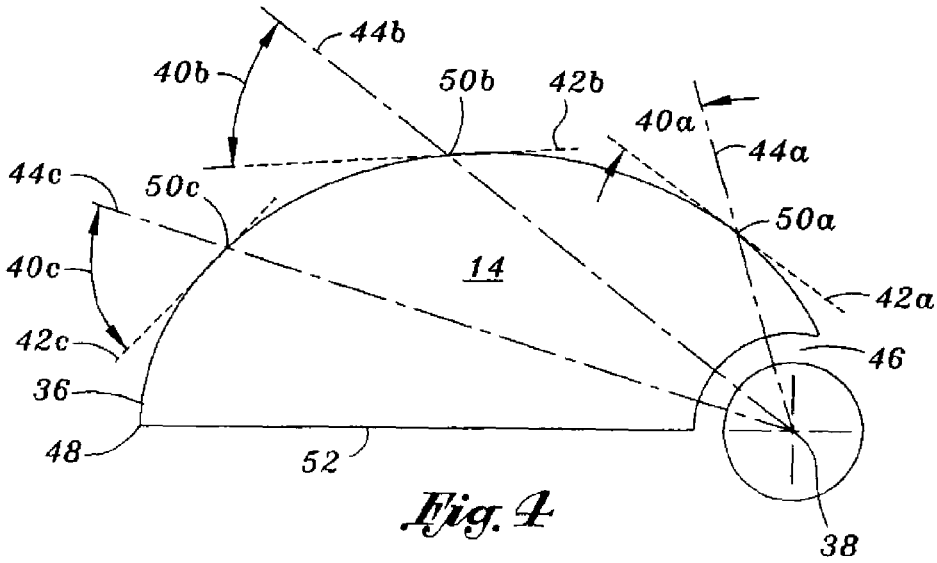
FIG. 4 is an outline of one blade of the propeller illustrating leading edge angles increasing logarithmically from a base to a tip of the blade and wherein the leading edge angle at the blade base is at least about 27 degrees.

The spiral shape of each leading edge 36 may approximate a logarithmic spiral. In particular, as shown in FIG. 4 which is an outline of one blade 14 of the propeller 12, leading edge angles 40*a-c* defined by a tangent line 42*a-c* to the leading edge 36 and a corresponding radial line 44*a-c* has a logarithmically increasing angle starting from a base 46 of the blade 14 to a tip 48 of the blade 14. The radial line 44 is defined by the central propeller axis 38 of the propeller 12 and the intersection 50*a-c* of the tangent line 42*a-c* and the leading edge 36. For example, FIG. 4 shows three leading edge angles 40*a-c*. The first leading edge angle 40*a* is near the base 46 of the blade 14, the second leading edge angle 40*b* is at a medial portion of the leading edge 36, and the third leading edge angle 40*c* is near the tip 48 of the blade 14. The first leading edge angle 40*a* may be equal to about 37.7 degrees, the second leading edge angle 40*b* may be equal to about 42.4 degrees and the third leading edge angle 40*c* may be equal to about 63.4 degrees.

At the tip 48 of the blade 14, the leading edge angle 40 may equal 90 degrees and at the base 46 of the blade, the leading edge angle 40 may be at least about 27 degrees. As such, as the leading edge angles 40 are calculated along the leading edge 36 beginning from the base 46 to the tip 48 of the blade 14, the leading edge angle 40 increases at a faster rate along the length of the leading edge 36. The rate of increase in the leading edge angle 40 along the leading edge 36 may approximate a logarithmic function. This logarithmic spiral helps the blades 14*a-e*, as the propeller 12 rotates, to cut and shed seaweed and kelp off of the propeller 12. Moreover, the logarithmic spiral shaped blades 14*a-e* may cut and shed seaweed and kelp off of the propeller 12 at low speeds. Accordingly, a propeller 12 having the above characteristics may be employed in slow speed boats designed to traverse waters containing seaweed and kelp. The logarithmic spiral shaped blades 14*a-e* also provide skew to the planform for blade stability and noise reduction.

Figure 2:
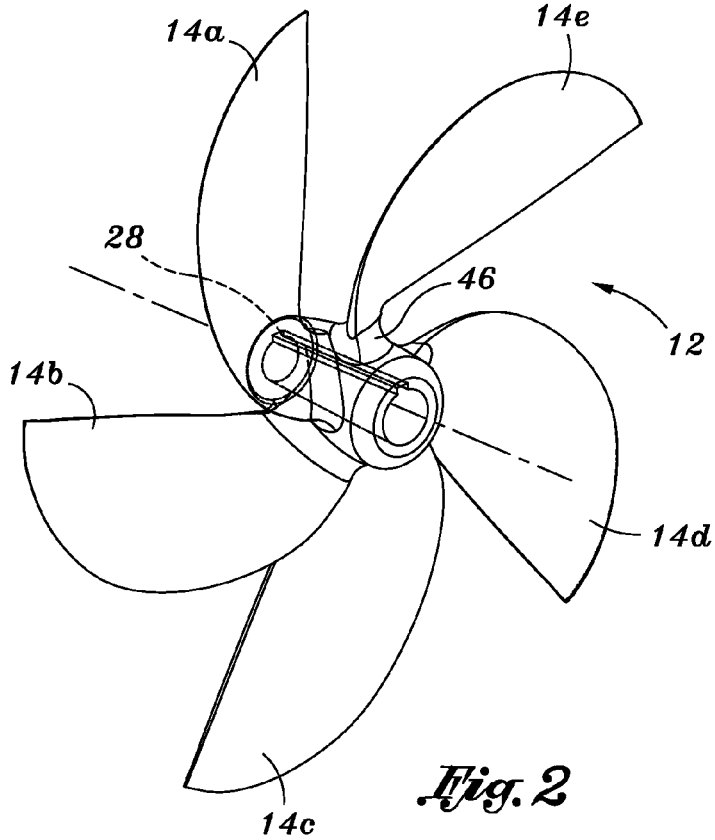
FIG. 2 is a rear perspective view of the propeller of FIG. 1.

Each of the propeller blades 14*a-e* may have a straight trailing edge 52*a-e*, as shown in FIGS. 3 and 4 in combination with the spiral shaped leading edge 36*a-e*. The straight trailing edge 52*a-e* may extend from the blade base 46*a-e* to the blade tip 48*a-e*. At the blade tip 48*a-e*, the straight trailing edge 52*a-e* may converge with the spiral shaped leading edge 36*a-e*, respectively. At the blade base 46*a-e*, the blade 14 is connected to the hub 18 of the propeller 12 via methods such as welding and other methods for attaching the blade 14 to the propeller hub 18. As shown in FIG. 2, the blade base 46 defines a concave configuration that smoothly extends onto the external surface of the hub 18. In this manner, the blades 14*a-e* smoothly cuts through the water as the propeller 12 rotates.

Figure 5:
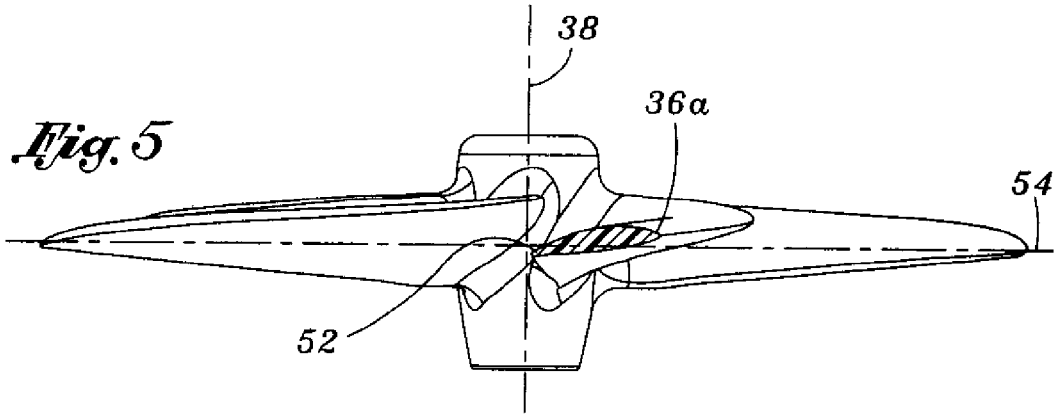
FIG. 5 is a radial cross section of a blade shown in FIG. 3 near the blade tip.
Figure 6:
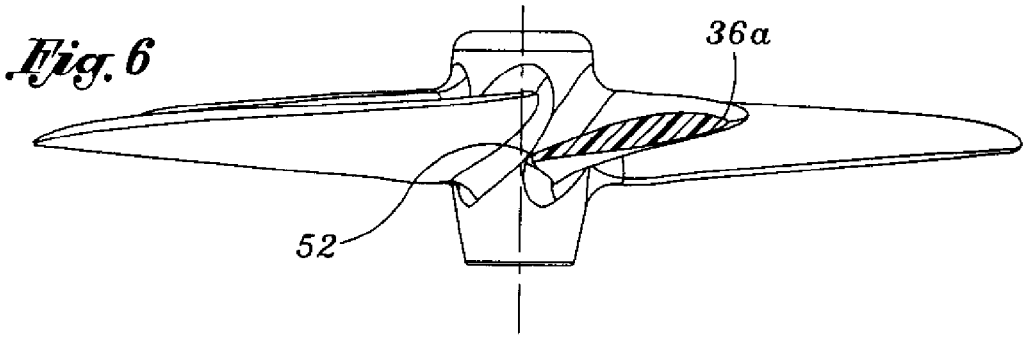
FIG. 6 is a radial cross section of the blade shown in FIGS. 3 and 5 closer to the blade base compared to the radial cross section shown in FIG. 5.

Referring now to FIGS. 3 and 5-7, the radial cross sections (see FIG. 7) of the blades 14 may have an air foil configuration. The radial cross section is a cross section of the blade 14 at different distances from the central propeller axis 38. As shown in FIGS. 5 and 6, two radial cross sections of a blade 14*a* are shown. FIG. 5 shows a radial cross section of the blade 14*a* closer to the blade tip 48 compared to the radial cross section of the blade 14*a* shown in FIG. 6. Nonetheless, each of the radial cross section has an air foil shape. In comparing cross sections shown in FIGS. 5 and 6, the angle of attack of the air foils increases from the blade tip 48 to the blade base 46. At the blade base 46, the angle of attack of the air foil is approximately 45 degrees to a plane 54 perpendicular to the central propeller axis 38. In comparison, at the blade tip 48, the angle of attack of the air foil approaches zero degrees.

Figure 7:
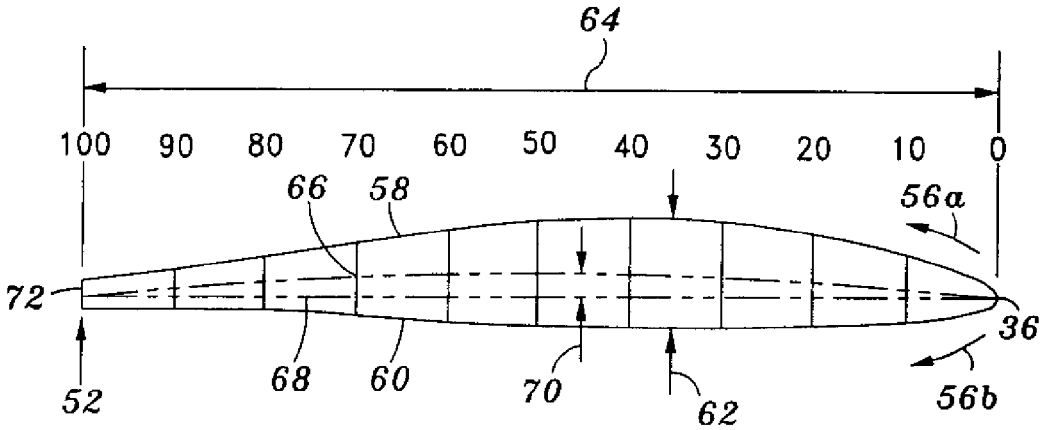
FIG. 7 illustrates a radial cross section having a generally air foil shape.

Each cross section of the blade 14 has substantially the same general shape. For example, each cross section of each blade 14 may have a curved leading edge 36*a*, 36, as shown in FIGS. 5-7. The curvature of the leading edge 36*a* is shown in FIGS. 5 and 6, and more clearly shown in FIG. 7. The curvature of the leading edge 36 (see FIG. 7) starts at a point then smoothly curves in two directions 56*a, b* (see FIG. 7) toward the trailing edge 52 to form a leading edge 36 that allows water to flow past the leading edge 36 smoothly. On the opposite side of the leading edge 36 is the trailing edge 52 which may have a cut off cross sectional configuration, as shown in FIGS. 5 and 6, and more clearly shown in FIG. 7. The trailing edge 52 is connected to the leading edge 36 by a front face surface 58 and back face surface 60. As stated above, the leading edge 36 starts from a point and smoothly curves in two directions 56*a, b* to the trailing edge 52. The first direction 56*a* is defined by the front face surface 58 and the second direction 56*b* is defined by the back face surface 60. At the trailing edge 52, the front and back face surfaces 58, 60 are cut off, as shown in FIG. 7.

Additionally, the cross sections of each blade 14 may have an ideal thickness ratio of about twelve percent to about fifteen percent, and preferably, each cross section of each blade 14 may have an ideal thickness ratio of about twelve percent. Referring now to FIG. 7, the thickness ratio of each cross section is defined by a maximum thickness 62 of the cross section divided by a chord length 64 of the cross section. The chord length 64 is the total length of the cross section of the blade 14. The maximum thickness 62 of the cross section of the blade 14 is the thickest portion of the cross section. Preferably, the maximum thickness 62 of the blade cross section is about the midpoint of the chord length 64. For example, the maximum thickness 62 of the blade cross section shown in FIG. 7 is approximately at about 35% of the cord length 64. If the cord length 64 is 10 inches and the maximum thickness 62 is 1.2 inches then the thickness ratio is 12%. In the blades 14*a-e* of the present invention, the thickness ratios of the cross sections along the length of each blade 14 are about 12%. These design considerations enhances the stiffness and strength of the blade 14.

Moreover, the cross sections of each blade 14 may have a camber percentage in relation to a mean camber line 66 and a mean chord line 68 less than three percent to prevent cavitation. The camber percentage is a ratio of the largest distance 70 between the mean camber line 66 and a mean chord line 68, and the chord length 64. The mean chord line 68 extends in a straight line from the leading edge 36 of the blade cross section and terminates at the trailing edge 52. More particularly, the mean chord line 68 terminates at the mid point of a rear flat surface 72. The mean chamber line 68 is a line formed by tracing the midpoint between the front face surface 58 and the back face surface 60 of each cross section. As shown in FIG. 7, the mean camber line 66 starts from the leading edge 36 proceeds through the midpoints of the front face surface 58 and the rear face surface 60, and then terminates at the midpoint of the rear flat surface 72. The largest distance 70 between the mean camber line 66 and the mean chord line 68 may be located near the maximum thickness 62. For example, the largest distance 70 between the mean camber line 66 and the mean chord line 68 shown in FIG. 7 is located at about 45% of the chord length 64.

The propeller 12 discussed herein may be fabricated from a metal, plastic, or other material dependent upon the intended use and purpose of the boat 10. For low speed boats 10, preferably, the propeller 12 is fabricated from urethane plastic. Fabricating the propeller 12 from urethane plastic allows the blades 14 to break off when the blades 14 hit an object such that the motor and electronics are not stressed. Accordingly, a propeller 12 incorporating the various aspects discussed herein fabricated from urethane plastic provides a propeller 12 that has sufficient stiffness for the propelling a boat yet the blades are able to snap/break off when the blades 14 hit an object.

The above various aspects of the present invention were discussed in relation to a blade 14 having a cross sectional shape of an airfoil. However, it is also contemplated within the scope of the present invention that the various aspects of the present invention discussed herein may be employed with other blade types such as hybrid, NASA, Troost, and Ogival depending on the desired speed of the boat, propeller revolutions per minute, available horsepower and boat weight.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A propeller for a motor of a boat, the motor having a rotating output shaft extending along a propeller axis, the propeller comprising:

a hub connectable to the rotating output shaft; and a plurality of blades, each blade including:

a concave blade base connected to the hub; and a blade body portion connected to the blade base, the blade body portion having a leading edge and a trailing edge each extending from the blade base and intersecting at a blade tip, the leading edge being sized and configured in the shape of a logarithmic spiral, the trailing edge being linear and extending along an axis offset from intersection with the propeller axis;

wherein a leading edge angle of the leading edge increases logarithmically from the concave blade base to the tip of the blade, the leading edge angle being defined by a tangent line to the leading edge and a radial line from a center of the propeller to the intersection of the tangent line to the leading edge.

2. The propeller of claim 1 wherein the leading edge angle at the blade base is at least 27 degrees.

3. The propeller of claim 1 wherein the blades are fabricated from urethane plastic.

4. The propeller of claim 1 wherein cross sections of each blade has a thickness ratio of about 12%, the thickness ratio being defined by a ratio of a maximum thickness of the cross section and a chord length of the cross section.

5. The propeller of claim 1 wherein cross sections of each blade has a percentage camber of less than 3%, the percentage camber defined by a ratio of the largest distance between a mean chord line and a mean camber line to a chord length of the cross section.

6. The propeller of claim 1 having five blades.

7. The propeller of claim 6 wherein the five blades are attached to the hub and angularly equidistantly spaced apart from each other.

8. The propeller of claim 1, wherein the blade body portion further includes: front and rear surfaces extending between the leading and trailing edges.

9. The propeller of claim 8, wherein the blade base further includes:

a forward base portion extending between the forward surface to the hub, the forward base portion defining a concave forward base surface; and a rear base portion extending between the rear surface to the hub, the rear base portion defining a concave rear base surface.

10. The propeller of claim 1, wherein the logarithmic spiral being characterized by the following equation, $r=ae^{b\theta}$, wherein r is the radial line, a and b are constants, and θ is an angle defined by the trailing edge axis and the radial line.

11. A propeller for a motor of a boat, the motor having a rotating output shaft, the propeller comprising:

a hub connectable to the rotating output shaft; and a plurality of blades, each blade including:

a blade body portion;

a concave blade base extending between the blade body portion and the hub, the concave blade base smoothly extending onto the exterior surface of the hub;

a leading edge extending between the concave blade base and a blade tip, the leading edge being sized and configured in the shape of a logarithmic spiral, each blade having a radial cross section being orthogonal to the leading edge, the radial cross section having a cross section periphery in the shape of an airfoil defining an angle of attack that increases from the blade tip to the blade base; and a trailing edge extending linearly between the blade tip and the blade base, the trailing edge being non-orthogonal to the tangent of the hub at the intersection of the hub and the axis along which the trailing edge extends;

wherein a leading edge angle of the leading edge increases logarithmically from the blade base to the blade tip, the leading edge angle being defined by a tangent line to the leading edge and a radial line from a center of the propeller to the intersection of the tangent line to the leading edge.

12. The propeller of claim 11, wherein the blade base further includes:

front and rear surfaces extending between the leading and trailing edges;

a forward base portion extending between the forward surface to the hub, the forward base portion defining a concave forward base surface; and a rear base portion extending between the rear surface to the hub, the rear base portion defining a concave rear base surface.

13. The propeller of claim 11, wherein the logarithmic spiral being characterized by the following equation, $r=ae^{b\theta}$, wherein r is the radial line, a and b are constants, and θ is an angle defined by the trailing edge axis and the radial line.

14. The propeller of claim 11 wherein the leading edge angle at the blade base is at least 27 degrees.

15. The propeller of claim 14 wherein cross sections of each blade has a thickness ratio of about 12%, the thickness ratio being defined by a ratio of a maximum thickness of the cross section and a chord length of the cross section.

16. The propeller of claim 11 wherein cross sections of each blade has a thickness ratio of about 12%, the thickness ratio being defined by a ratio of a maximum thickness of the cross section and a chord length of the cross section.

17. The propeller of claim 11 wherein cross sections of each blade has a percentage camber of less than 3%, the percentage camber defined by a ratio of the largest distance between a mean chord line and a mean camber line to a chord length of the cross section.

18. The propeller of claim 1, wherein the trailing edge is non-orthogonal to the tangent of the hub at the intersection of the hub and the axis along which the trailing edge extends.

19. The propeller of claim 11, wherein the rotating output shaft extends along a propeller axis and the trailing edge extends along an axis offset from intersection with the propeller axis.

* * * * *